United States Patent [19]

East

[11] 4,160,361

[45] Jul. 10, 1979

[54] JEWELRY BRACELETS

[75] Inventor: Harvey J. East, Holsworthy, England

[73] Assignee: Aurifex Limited, Holsworthy, England

[21] Appl. No.: 908,955

[22] Filed: May 24, 1978

[30] Foreign Application Priority Data

Jun. 2, 1977 [GB] United Kingdom ..... 23547/77

[51] Int. Cl.[2] ..... F16G 15/00

[52] U.S. Cl. ..... 59/82; 59/85

[58] Field of Search ..... 59/78, 80, 82, 83, 84, 59/85, 90, 91, 35; 63/4, 9

[56] References Cited

U.S. PATENT DOCUMENTS

| | | | |
|---|---|---|---|
| 1,243,537 | 10/1917 | Lynn | 59/80 |
| 2,489,211 | 2/1950 | Kreisler | 59/35 |
| 2,610,463 | 9/1952 | Prestinari | 59/80 |

*Primary Examiner*—Lowell A. Larson
*Assistant Examiner*—Gene P. Crosby
*Attorney, Agent, or Firm*—Posnack, Roberts, Cohen & Spiecens

[57] ABSTRACT

A chain link bracelet of the cross-weave or polynese type is lengthened or shortened by adding or removing a chain link assembly which consists of a pair of flattened helices which are coupled permanently in mesh by a captive hinge pin. The assembly is coupled to the bracelet by means of a releasable headed pin which passes through the intercalating convolutions of the link assembly and the bracelet.

5 Claims, 3 Drawing Figures

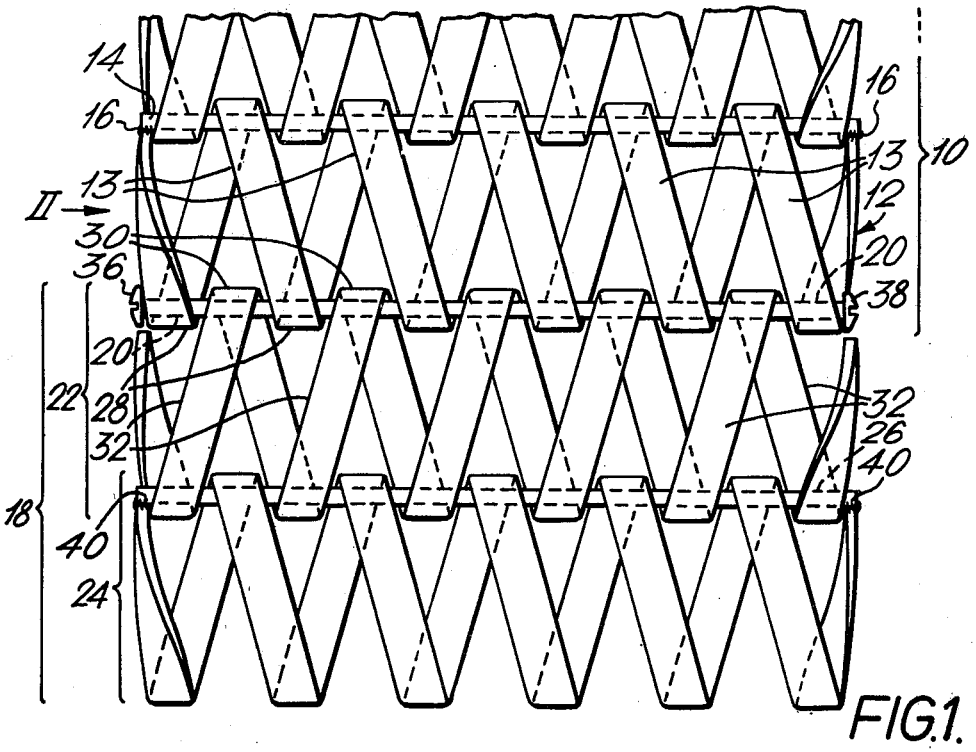
FIG.1.
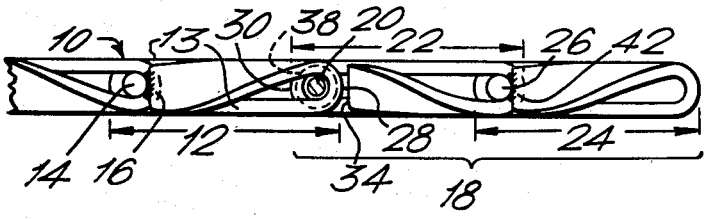
FIG.2.
FIG.3.
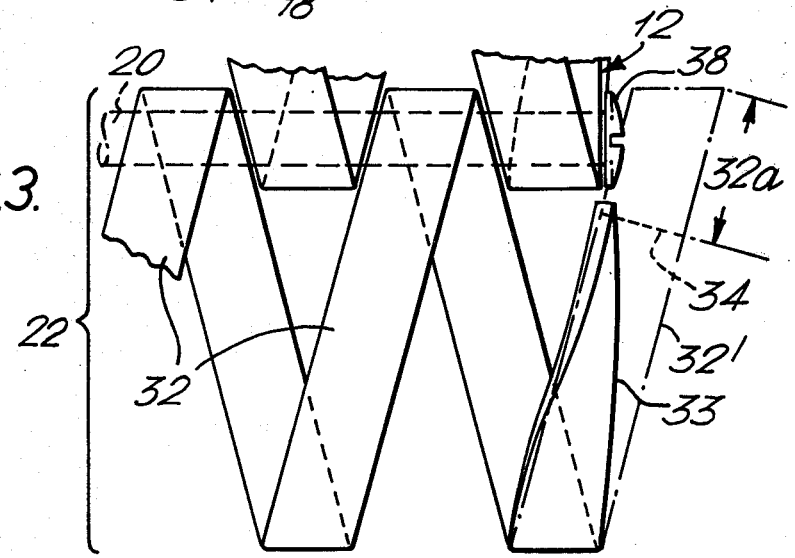

JEWELRY BRACELETS

FIELD OF INVENTION

This invention relates to jewellery bracelets of the chain link type in which a plurality of chain links, each consistituted by several turns of a flattened right-hand or a left-hand helix of wire or narrow strip, are meshed together in a series of alternately right-hand and left-hand helices so that their respective convolutions intercalate. The intercalated helices are mechanically coupled together to form a chain of such links by passing a hinge or coupling pin through the passage or tunnel formed by their meshing or overlapping arcs and permanently locking the pin in place — as by soldering it to the free ends or tails of at least one of the helices.

BACKGROUND

The ordinary link of such a bracelet consists of a whole number of complete "turns" or convolutions so that the free ends or tails of the wire or strip forming the helix can engage the ends of a plain captive hinge pin and render it captive, either by being soldered to its ends when it is substantially the same length as the axial length of the helix or by being bent mutually inwards so as to enter the ends of the tunnel when the pin is shorter. The flattened helices of a cross-weave or polynese chain link bracelet are thus all orientated in the same attitude, viz: the free ends or tails of the wire or strip forming each helix are directed in the same sense lengthwise of the bracelet prior to their soldering or deformation to render the respective hinge pins captive. Each flattened convolution of a helix has 180° arcs at each end which intercalate with the exposed end arcs of the next links in the bracelet, except for the link at each end of a bracelet. Each of the latter intercalates with only one link, its exposed end arcs being attached to a clasp, or a watch case, or whatever article is carried by the bracelet.

Shortening or lengthening of bracelets of the chain link type has always required technical skill and dexterity in that shortening has involved cutting a link to free it from the pin which connects it with the adjacent link; and lengthening has involved the meshing of the exposed end convolutions of the final link of the existing bracelet with those of a new link and locking them together by inserting and rendering captive a new hinge pin.

SUMMARY OF INVENTION

It is an object of the present invention to simplify the shortening and lengthening of a chain link bracelet by providing a detachable link assembly which can be added thereto or removed therefrom without the need for special skill or tools.

Another object is to provide a detachable chain link assembly comprising a pair of oppositely handed flattened helices permanently coupled by a captive hinge pin, the free ends or tails of one helix being cut short sufficiently to allow a releasable headed pin to be passed freely through the convolutions at the exposed end of the helix.

A further object is a method of making a chain link bracelet which comprises forming a detachable link assembly from a pair of oppositely handed flattened helices the convolutions of which are intercalated and locked in mesh by passing a hinge pin through the tunnel formed by their overlapping end arcs; engaging the free ends or tails of one helix with said pin to render it captive therein; cutting short the free ends or tails of the other helix sufficiently to allow free access for a releasable headed pin to the tunnel through the exposed end arcs of the other helix; intercalating the said exposed arcs with the final link of the bracelet; inserting said releasable headed pin into the said tunnel to lock the meshing convolutions together, and releasably securing the pin in position.

BRIEF DESCRIPTION OF DRAWING

A preferred embodiment of the present invention is illustrated, by way of example only, in the accompanying drawing in which:

FIG. 1 is a somewhat stylized plan view of a section of a bracelet of the chain link type including a releasable pin;

FIG. 2 is an elevation, in the direction of the arrow II of FIG. 1, on an enlarged scale; and FIG. 3 is an enlarged fragmentary view of one free end or tail of a helix adjacent a headed releasable pin, showing how it is cut back to clear the pin and the tunnel through which it passes.

DETAILED DESCRIPTION

The cross-weave bracelet 10 terminates in a (right-hand) final helix 12 which has been crushed so as to elongate each convolution 13. The pin 14 which couples it to the remainder of the bracelet 10 is captive, as by being soldered at each end to the free end or tail 16 of a helix. A detachable link assembly 18 is joined to the bracelet 10 by means of a headed releasable pin 20 and consists of a pair of oppositely handed flattened helices 22, 24 interconnected by a captive hinge pin 26 which corresponds to the pin 14 coupling intercalating helices of the bracelet 10. The captive pin 26 can be soldered or otherwise permanently secured to one or both helices 22, 24. As shown in FIG. 1, it is secured at 40 to the helix 22, as shown in FIG. 2, it is secured at 42 to the helix 24.

The body of the releasable pin 20 is designed to pass through the tunnel formed by meshing the exposed end arcs 28 of the flattened convolutions 13 of the final helix 12 of the bracelet 10 and the exposed end arcs 30 of the flattened convolutions 32 of the adjacent helix 22 of the detachable link assembly 18. The normal free end or tail of the helix 22 is shown in chain lines at 32'. In order to adapt the helix 22 to the link assembly 18 of the present invention, the portion **32*a* which interferes with free access to the tunnel for the releasable headed pin 20 is cut back to the line 34 so that the shortened tail can be bent inwards to the full line position 33 where it cannot obstruct the head 38 of the headed releasable pin 20. The shortened tail 33 is not secured to any pin or other convolution, and remains "free". Care must therefore be taken to insure that it does not project beyond the lateral margin of the bracelet 10. The cut end should also be smoothed to minimize snagging of clothing when in use. When finally assembled, the pin 20 has heads 36, 38 at its ends of a size to prevent unintentional axial withdrawal. In FIG. 2, the releasable pin 20 is shown in tubular form, its ends being threaded to receive respective headed screws 36, 38 (FIG. 1). Alternatively, only one end need be threaded to receive a screw 36, the other end having its head 38 integral to match the head of the screw 36**.

A bracelet 10 having its final convolutions 13 crushed so that the exposed end arcs are rounded to a radius not less than that of a releasable pin 20 and coaxially aligned will always be capable of extension by the addition of one or more link assemblies 18. The invention thus includes a cross-weave or other bracelet of the chain link type having a link assembly or assemblies, or a clasp or other accessory attached thereto or detachable therefrom at will without the necessity of soldering or cutting, as the case may be.

I claim:

1. A detachable link assembly for a chain link bracelet comprising a pair of oppositely handed flattened helices including convolutions having meeting ends in the form of arcs which intercalate and cooperatively form a tunnel, said helices having respective free ends;

a captive hinge pin passing through the tunnel formed by said intercalating arcs and engaged by the free ends of one of said helices, the convolutions of one of said helices including exposed end arcs defining a tunnel; and a releasable headed pin adapted to pass through the tunnel formed by the exposed end arcs, the free ends of the helix including the exposed end arcs being foreshortened so as not to obturate said tunnel.

2. A detachable link assembly according to claim 1 wherein said releasable pin includes heads at opposite ends thereof and the latter said helix has said free ends foreshortened far enough to clear the adjacent head of said releasable pin.

3. A detachable link assembly according to claim 2 wherein said free ends are foreshortened by at least the diameter of the head of said releasable headed pin.

4. The method of making a chain link bracelet as claimed in claim 1 which comprises intercalating a pair of oppositely handed flattened helices;

locking said helices in mesh by means of a captive hinge pin;

engaging the tails of one helix with said hinge pin to render said pin captive;

shortening the tails of the other helix by an amount sufficient to insure that said tails do not obturate the tunnel through the adjacent end arcs of the flattened convolutions of said other helix; and passing a releasable headed pin through said tunnel to lock said end arcs of said flattened convolutions with intercalating convolutions of another component.

5. The method according to claim 4 comprising deforming the thusly shortened tails of said other helix mutually inwards at least flush with the heads of said releasable headed pin.

* * * * *